US009432757B2

(12) United States Patent
Faranda et al.

(10) Patent No.: US 9,432,757 B2
(45) Date of Patent: Aug. 30, 2016

(54) ADJUSTABLE SPEAKER RIGGING SYSTEM

(71) Applicant: Mitek Corp., Inc., Phoenix, AZ (US)

(72) Inventors: Anthony R. Faranda, Erie, PA (US); Richard P. Chase, Corry, PA (US)

( * ) Notice: Subject to any disclaimer, the term of this patent is extended or adjusted under 35 U.S.C. 154(b) by 319 days.

(21) Appl. No.: 14/159,873

(22) Filed: Jan. 21, 2014

(65) Prior Publication Data

US 2014/0205126 A1 Jul. 24, 2014

Related U.S. Application Data

(60) Provisional application No. 61/755,847, filed on Jan. 23, 2013.

(51) Int. Cl.
*H04R 1/02* (2006.01)
*H04R 1/40* (2006.01)

(52) U.S. Cl.
CPC ..... *H04R 1/026* (2013.01); *H04R 1/403* (2013.01)

(58) Field of Classification Search
CPC .... H04R 1/02; H04R 1/026; H04R 2201/02; H04R 2201/021; H04R 2201/025
USPC ..... 381/87, 332, 334, 335, 336, 182, 386, 381/387, 395; 181/198, 199
See application file for complete search history.

(56) References Cited

U.S. PATENT DOCUMENTS

| | | | | |
|---|---|---|---|---|
| 5,996,728 | A | 12/1999 | Stark | |
| 7,036,781 | B1 | 5/2006 | Bothe | |
| 7,261,180 | B1 | 8/2007 | Faranda et al. | |
| 8,170,263 | B2 | 5/2012 | Engebretson et al. | |
| 2002/0121847 | A1* | 9/2002 | Christner | H04R 9/00 312/111 |
| 2007/0000719 | A1 | 1/2007 | Bothe | |
| 2011/0305362 | A1 | 12/2011 | McGhee et al. | |
| 2012/0093347 | A1* | 4/2012 | Adamson et al. | H04R 1/026 381/300 |

FOREIGN PATENT DOCUMENTS

| | | |
|---|---|---|
| WO | WO02067243 A2 | 8/2002 |

* cited by examiner

*Primary Examiner* — Paul S Kim
*Assistant Examiner* — Katherine Faley
(74) *Attorney, Agent, or Firm* — Keith L. Jenkins, Registered Patent Attorney, LLC; Keith L. Jenkins

(57) ABSTRACT

Opposing strings of pivotally coupled rigid members attach to opposing sides of tapered speaker cabinets in an array of speaker cabinets. Attachment is made near the front cabinet edges and a rear adjustable coupling string of brackets and adjustable couplings connect to the rear of the tapered speaker cabinets. Actuation of the adjustable couplings enables continuous adjustment of the angular relationships of the speaker cabinets while under load. A three-point fly frame coupling is provided. A three-point dolly coupling is provided.

16 Claims, 9 Drawing Sheets

ADJUSTABLE SPEAKER RIGGING SYSTEM

RELATED APPLICATION

This application claims the benefit of U.S. provisional patent application 61/755,847 filed Jan. 23, 2013 on behalf of the same inventors.

TECHNICAL FIELD

This invention relates to providing an adjustable rigging system for audio speakers that allows an array of audio speakers to be adjusted while under load. In particular, this invention relates to providing a continuously adjustable rigging system for arrays of audio speakers that are angled with respect to each other, and providing a system for adjusting the angles while the speakers are under load.

BACKGROUND

Arrays of large speakers are used for concerts, arena events, and the like. For best acoustic adaptation to a particular venue, acoustic engineers calculate the angles at which the speakers should be pointed to produce the best sound. Riggers then install the speakers at those calculated angles. The speakers may be suspended by wires or supported on wheeled platforms. A need for adjusting arrays of large audio speakers arises in the context of a reconfiguration of the venue, either by event-specific reconfigurations or from the users moving between venues. The reconfigured venue requires changes in the acoustic calculations and adjustment of the audio speaker arrays.

Prior systems provide discrete increments of adjustment, and further require that the speakers not be under load during the adjustment. The discrete increment systems limit the precision with which the calculations of the acoustic engineers can be implemented, and the unloading requirement requires a disassembly of the array, which is costly in labor and time.

Therefore, a need exists for a speaker rigging system that provides for continuous adjustment (as opposed to discrete increments) that can be performed under load.

OBJECTS AND FEATURES OF THE INVENTION

A primary object and feature of the present invention is to overcome the above-mentioned problems and fulfill the above-mentioned needs.

Another object and feature of the present invention is to provide a system that enables continuous adjustment of the audio speaker array.

It is a further object and feature of the present invention to provide a system that enables continuous adjustment of the audio speaker array under load.

It is a further object and feature of the present invention to provide a system that is simple and easy to manufacture.

It is a further object and feature of the present invention to be useful for suspended and supported audio speaker arrays.

It is an additional primary object and feature of the present invention to provide such a system that is efficient, inexpensive and handy. Other objects and features of this invention will become apparent with reference to the following descriptions.

SUMMARY OF THE INVENTION

Hereinafter, the term "speakers" is defined and used to include audio speaker cabinets that contain audio speakers.

The rigging apparatus of the present invention attaches to and enables adjustment of an array of speakers. The system comprises apparatus for pivotably coupling the front edges of a plurality, or array, of speakers together and apparatus for adjustably coupling the backs of the plurality, or array, of speakers together. The system may also include a wheeled support, or customized wheel board, that can be pivotably coupled to the front of the bottom edge of a speaker at the bottom of a vertical linear array of speakers. In addition, a fly frame is used to support the array of speakers from above by attaching, on its underside, to the top ends of the coupling devices (a three-point connection) and to lifting cables on its top side. The system also includes speakers shaped to enable angular adjustment.

The rigging allows the angles between cabinets to be adjusted, when the system is flown (suspended by cables) or ground stacked, while under load. With existing rigging systems, either the cabinets must be decoupled, or one cabinet disconnected from the others, to make adjustments. The adjustment for the present invention is continuously variable. Existing systems are adjusted by moving pins that at are set at predetermined intervals and, in some instances, those adjustment increments are quite large. The rigging system of the present invention never "free wheels" while it is being adjusted. The adjustment stops, and the system does not continue to move, after the adjustment stops. Existing systems cannot be adjusted at all while they are under load. With the present rigging system, not only can adjustments be made while the system is under load, but they can be done safely. One person with a wrench can change the angles between sixteen cabinets if necessary. The system is calibrated in small increments and adjustments can be duplicated or repeated easily.

In a first embodiment, the invention provides an adjustable speaker rigging system for configuring a plurality of speaker cabinets in an array of speaker cabinets into desired adjustable angular relationships, the system including: first and second front strings of coupling devices; a rear coupling adjustment apparatus; and where the rear coupling adjustment apparatus can be adjusted under load. The adjustable speaker rigging system, where the first and second front strings of coupling devices each includes: a plurality of rigid elongated members each having first and second opposing member ends and configured to be attached to a side of a speaker cabinet proximate a front edge of the speaker cabinet; the first opposing member end configured to transversely receive a locking pin; the second opposing member end configured to receive a first opposing member end of another flat rigid elongated member of the plurality of flat rigid elongated members and to transversely receive the locking pin to create a pivotable coupling. The adjustable speaker rigging system, where the rear coupling adjustment apparatus includes: a first plurality of brackets, each bracket configured to be attached to a rear portion of a speaker cabinet of the array of speakers; and a second plurality of adjustable couplings, each adjustable coupling configured to connect between two brackets of the first plurality of brackets. The adjustable speaker rigging system, where each adjustable coupling includes a continuously adjustable coupling. The adjustable speaker rigging system, where each adjustable coupling includes a turnbuckle. The adjustable speaker rigging system, where each bracket includes: a U-shaped rigid strip; a bracket coupling mounted on the U-shaped rigid strip configured to receive two adjustable couplings of the second plurality of adjustable couplings; and at least one tethered lock pin operable to couple the bracket coupling to the two adjustable couplings. The adjustable speaker rigging system, further including a fly frame configured to make a top three-point connection to the speaker cabinet array. The adjustable speaker rigging system, where first and second connectors of the top three-point connection are configured to couple to top first ends of the first and second front strings of coupling devices, respectively. The adjustable speaker rigging system, further including a wheeled dolly configured to make a bottom three-point connection to the speaker cabinet array. The adjustable speaker rigging system, where first and second connectors of the bottom three-point connection are to bottom second ends of the first and second front strings of coupling devices, respectively. The adjustable speaker rigging system, including at least two dolly couplings, each including: a base plate attachable to the dolly; and an upright member extending from the base plate and terminating in the form of the first opposing member end of the rigid elongated member. The adjustable speaker rigging system, further including the plurality of speaker cabinets.

In a second embodiment, the invention provides an adjustable speaker rigging system for configuring a plurality of speaker cabinets in an array of speaker cabinets into desired adjustable angular relationships, the system including: first and second front strings of coupling devices; a rear coupling adjustment apparatus; where the rear coupling adjustment apparatus can be adjusted under load; and where the rear coupling adjustment apparatus can be adjusted continuously. The adjustable speaker rigging system, where the first and second front strings of coupling devices each includes: a plurality of rigid elongated members each having first and second opposing member ends and configured to be attached to a side of a speaker cabinet proximate a front edge of the speaker cabinet; the first opposing member end configured to transversely receive a locking pin; the second opposing member end configured to receive one of: a first opposing member end of another flat rigid elongated member of the plurality of flat rigid elongated members and to transversely receive the locking pin to create a pivotable coupling; and a dolly coupling that is attached to a wheeled dolly. The adjustable speaker rigging system, where the rear coupling adjustment apparatus includes: a first plurality of brackets, each bracket configured to be attached to a rear portion of a speaker cabinet of the array of speaker cabinets; and a second plurality of adjustable couplings, each the adjustable coupling configured to connect between two brackets of the first plurality of brackets. The adjustable speaker rigging system, where each bracket includes: a U-shaped rigid strip; at least one bracket coupling mounted on the U-shaped rigid strip configured to receive two adjustable couplings of the second plurality of adjustable couplings; and at least one tethered lock pin able to couple the bracket coupling to the two adjustable couplings. The adjustable speaker rigging system, further including a fly frame configured to make a top three-point connection to the speaker cabinet array; where first and second connectors of the top three-point connection are configured to couple to top first ends of the first and second front strings of coupling devices, respectively. The adjustable speaker rigging system, further including a wheeled dolly configured to make a bottom three-point connection to the speaker cabinet array; where first and second connectors of the bottom three-point connection are to bottom second ends of the first and second front strings of coupling devices, respectively. The adjustable speaker rigging system, including at least two dolly couplings, each including: a base plate attachable to the dolly; and an upright member extending from the base plate and terminating in the form of the first opposing member end of the rigid elongated member.

In a third embodiment, the invention provides an adjustable speaker rigging system for configuring a plurality of speaker cabinets in an array of speaker cabinets into desired adjustable angular relationships, the system including: first and second front strings of coupling devices; wherein the first and second front strings of coupling devices each includes: a plurality of rigid elongated members each having first and second opposing member ends and configured to be attached to a side of a speaker cabinet proximate a front edge of the speaker cabinet; the first opposing member end configured to transversely receive a locking pin; the second opposing member end configured to receive a first opposing member end of another flat rigid elongated member of the plurality of flat rigid elongated members and to transversely receive the locking pin to create a pivotable coupling; and a rear coupling adjustment apparatus, comprising a first plurality of brackets, each bracket configured to be attached to a rear portion of a speaker cabinet of the array of speaker cabinets, wherein each bracket of the first plurality of brackets comprises: a U-shaped rigid strip; at least one bracket coupling mounted on the U-shaped rigid strip configured to receive two adjustable couplings of the second plurality of adjustable couplings; and at least one tethered lock pin operable to couple the at least one bracket coupling to the two adjustable couplings; a second plurality of adjustable couplings, each adjustable coupling configured to connect between two brackets of the first plurality of brackets; further comprising one of: a fly frame configured to make a top three-point connection to the speaker cabinet array, wherein first and second connectors of the top three-point connection are configured to couple to top the first ends of the first and second front strings of coupling devices, respectively; and a wheeled dolly configured to make a bottom three-point connection to the speaker cabinet array, wherein first and second connectors of the bottom three-point connection are to bottom second ends of the first and second front strings of coupling devices, respectively; wherein the rear coupling adjustment apparatus can be adjusted under load; and wherein the rear coupling adjustment apparatus can be adjusted continuously.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

As used and defined herein, the terms "continuous" and "continuously" when used to modify "adjustment" or "adjustable" means being able to adjust to any angle within the range of the device, in analog fashion, and not limited to discrete increments. As used and defined herein, the terms of art "flying" or "fly" refers to a speaker cabinet array that is suspended by cables. As used and defined herein, the term of art "under load" refers to a deployed and operational state and configuration of the speaker cabinet array.

Figure 1:
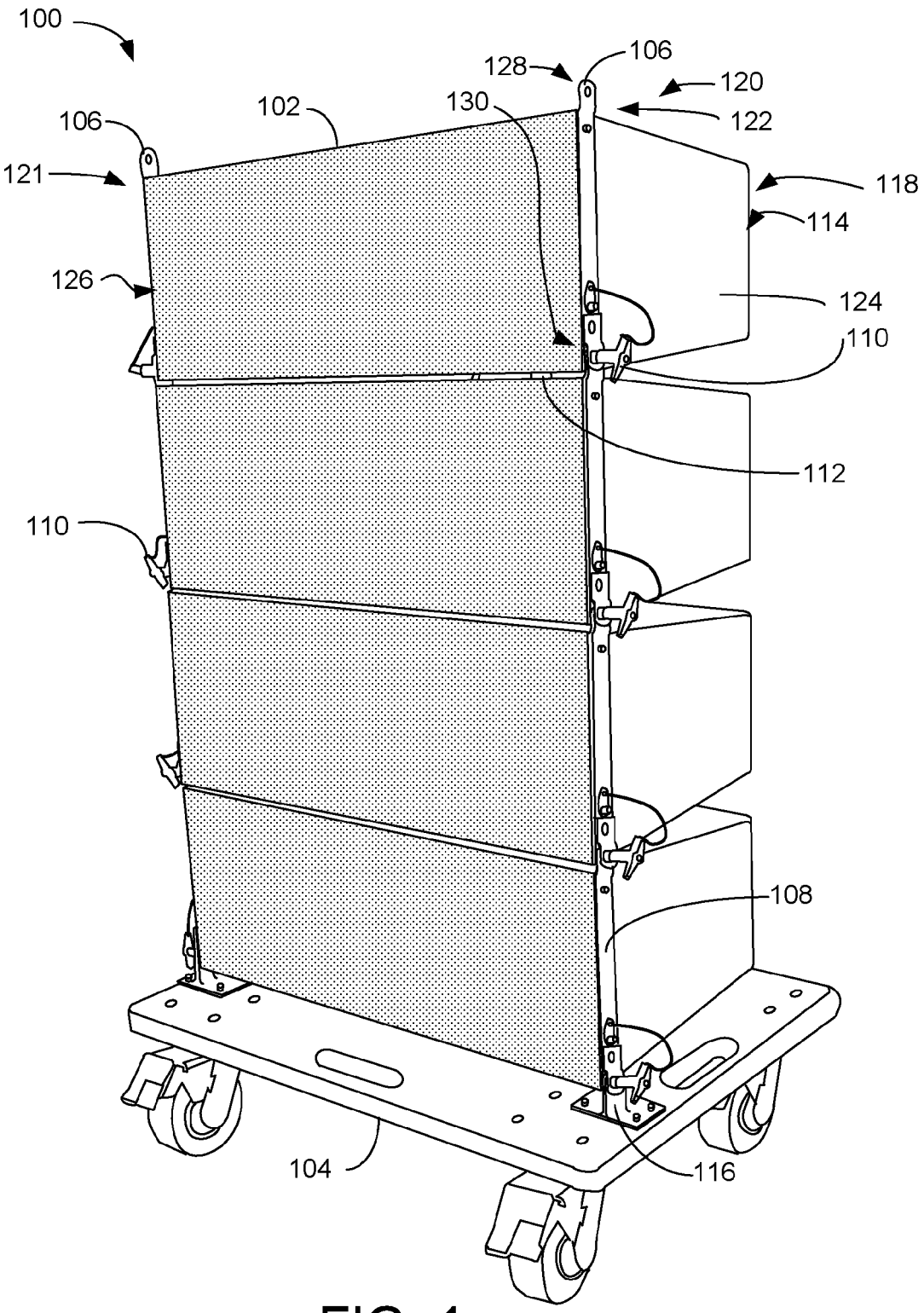
FIG. 1 is a front-right perspective view illustrating an exemplary apparatus for pivotably coupling the front edges of supported speaker cabinets, according to a preferred embodiment of the present invention.

FIG. 1 is a front-right perspective view illustrating an exemplary adjustable speaker rigging system 100, showing the front coupling apparatus 120 for pivotably coupling the front edges of supported speaker cabinets 118 according to a preferred embodiment of the present invention. Front coupling apparatus 120 comprises a left-front string 121 of coupling devices and a right-front string 122 of coupling devices. The adjustable speaker rigging system 100 comprises front coupling apparatus 120 and rear coupling adjustment apparatus 700 (see FIG. 7). In some embodiments, speaker cabinets 118 are part of the adjustable speaker rigging system 100, while in other embodiments, front coupling apparatus 120, and rear coupling adjustment apparatus 700 (see FIG. 7) may be adapted to legacy speaker cabinets 118. For supported speaker arrays 102, adjustable speaker rigging system 100 further comprises wheeled support 104, or customized wheel board 104.

Front coupling apparatus 120 includes left and right strings 121 and 122, each including a plurality of substantially rigid members, exemplified as flat strips 108, each with a first pivotable coupling portion 106 extending from a first end 128 of each strip 108 and a second complimentary pivotable coupling portion 202 (see FIG. 2) at the opposing second end 130 of each strip 108. Each strip 108 is fastened abutting a side surface 114 of a side wall 124 (one of four labeled) of a speaker cabinet 118 and adjacent a front surface 126 of the speaker cabinet 118. Fastening may be by bolts or other mechanical fasteners through the strip 108 and into structural members internal to the speaker cabinet 118. In another embodiment, fastening may be by adhesion. In yet another embodiment, strips 108 may be made integral with the speaker cabinet internal structure, with only first and second member ends 128, 130 extending outside the speaker cabinet 118. The first pivotable coupling portion 106 extends beyond the top of the speaker cabinet 118, as shown, and the second complimentary coupling portion 202 aligns, at its lower extent, near the bottom edge of the speaker cabinet 118. The strips 108 are attached at both left and right sides of speaker cabinets 118 along the front side edge. The first pivotable coupling portion 106 may be used, in a particular embodiment, to suspend the speaker array 102 by cables via a three-point fly frame 1200 (see FIGS. 12-15). The positioning of the strips 108 on the speaker cabinet 118 preferably aligns with an internal structural framework member 502 (see FIG. 5) of the speaker cabinet 118, such that the fasteners 302 (See FIGS. 3 and 4) that attach the strips 108 to the speaker cabinet 118 engage the internal structural member 502 (see FIG. 5), and do not rely on the strength of the cabinet side wall 124 for supporting the weight of the speaker cabinet 118. Strip 108 is preferably made of steel or aluminum. In particular embodiments, other materials that have the required strength and durability may be used.

In an additional embodiment, particularly useful with heavy loads, flat strips 108 may be replaced with two parallel spaced-apart flat strips 108 with a flat spacer in between for a central portion of the length. In such embodiment, the pivotable coupling portion 106 is created between the spaced-apart open ends of the two parallel spaced-apart flat strips 108.

First pivotable coupling portion 106 inserts into the second complimentary coupling portion 202 (see FIG. 2), such that holes in the first and second coupling portions 106 and 202 align to receive and retain locking pins 110 (two of eight labeled). The first and second coupling portions 106 and 202 are free to rotate about the locking pin 110, thereby creating a pivotable coupling 212 (see FIG. 2). The sum of all the coupled strips 108 on each side of the speaker array 102 are the left and right strings 121 and 122 comprising the front coupling apparatus 120.

A small portion of the rear coupling adjustment apparatus 700 (see FIG. 7), being turnbuckle nut 112, can be seen in this view.

In an embodiment in which the speaker array 102 is supported on customized wheel board 104, or dolly 104, customized wheel board 104 has left and right dolly couplings 116 that mimic first pivotable coupling portion 106 to provide a pivotable coupling 212 (see FIG. 2) between the dolly 104 and the bottom speaker cabinet 118.

Figure 2:
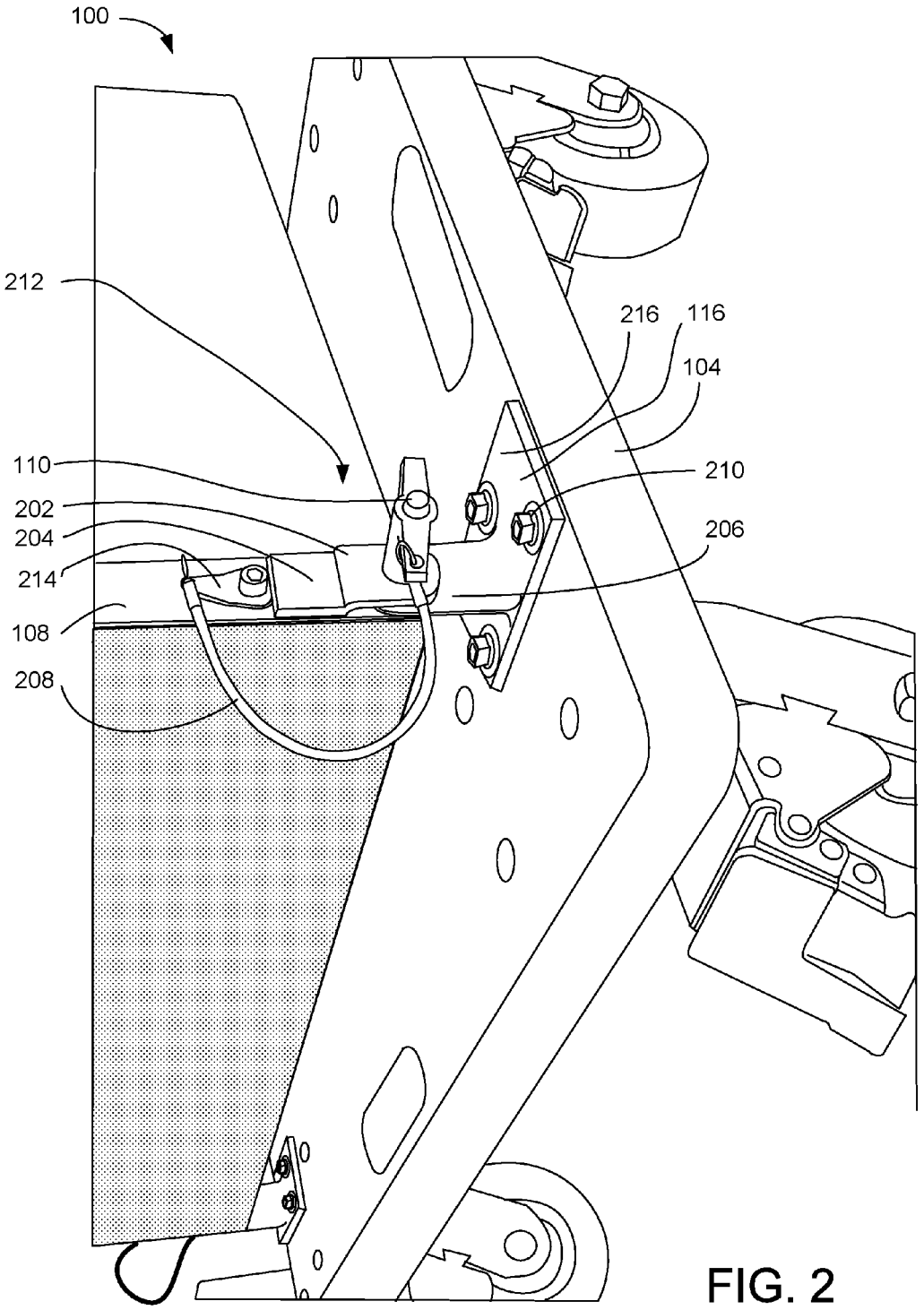
FIG. 2 is a front right perspective close up view of a portion of the exemplary apparatus of FIG. 1, illustrating an exemplary pivotable coupling between a wheeled support panel, or dolly, and a speaker cabinet, according to a preferred embodiment of the present invention.

FIG. 2 is a front right perspective close up view of a portion of the exemplary adjustable speaker rigging system 100 of FIG. 1, illustrating an exemplary pivotable dolly coupling 212 between a customized wheeled support 104, or dolly 104, and a speaker cabinet 118, according to a preferred embodiment of the present invention. Dolly coupling 116 includes a flat base 216 fastened (exemplified as bolt 210) to dolly 104 with a vertically upwardly extending pivotable coupling portion 206 (similar to 106) to provide a pivotable coupling 212 between the dolly 104 and the bottom speaker cabinet 118 when locking pin 110 is installed. Locking pin 110 is shown installed through second complimentary coupling portion 202 and first pivotable coupling portion 106, and tethered to strip 108 via tether 208 that connects between locking pin 110 and tether anchor 214. Tether anchor 214 is attached to strip 108 via fastener 404 (see FIG. 4), exemplified in FIG. 2 as a screw.

Second complimentary coupling portion 202 is a flange with a first end attached (exemplified as spot weld 204) to strip 108 and bending to create a second end 202 spaced apart from strip 108 to form a receiver 402 (see FIG. 4) for vertically extending pivotable coupling portion 206. In a particular embodiment, locking pin 110 extends through second complimentary coupling portion 202, first pivotable coupling portion 206 or 106, strip 108, the speaker cabinet side wall 114, and an internal speaker cabinet structural member 502 (See FIG. 5).

Figure 3:
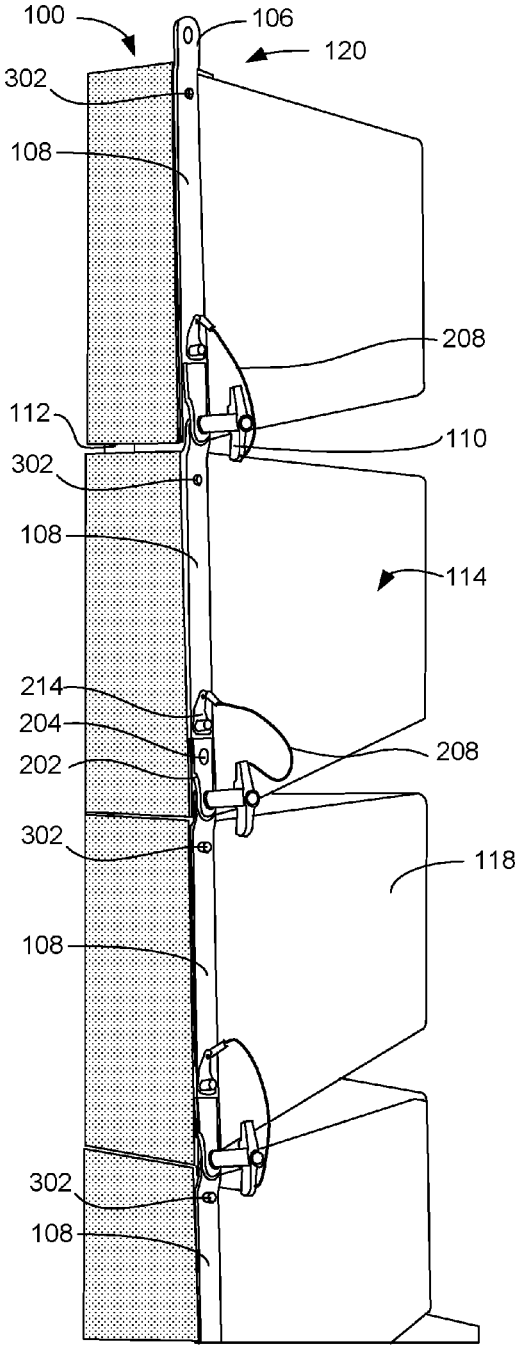
FIG. 3 is a front right perspective close up view of a portion of the exemplary front coupling apparatus of FIG. 1, illustrating an exemplary pivotable coupling between a plurality of speaker cabinets, according to a preferred embodiment of the present invention.

FIG. 3 is a front right perspective close up view of a portion of the exemplary adjustable speaker rigging system 100 of FIG. 1, illustrating an exemplary front coupling apparatus 120 between a plurality, or array 102, of speaker cabinets 118, according to a preferred embodiment of the present invention. Fasteners 302 are illustrated as bolts. On each strip 108, fasteners 302 near the tether anchors 205 are partially obscured in this view and are better illustrated in FIGS. 4 and 5. Then number of speaker cabinets 118 is not limited to the number shown.

Figure 4:
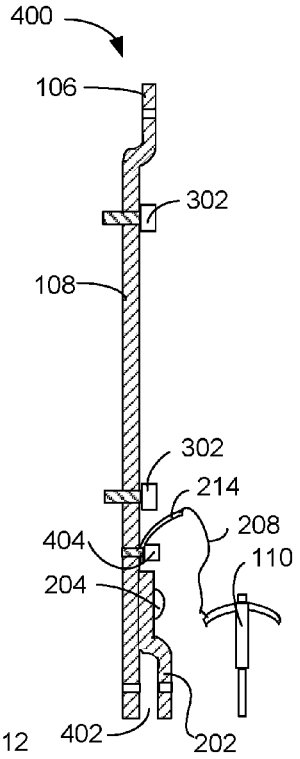
FIG. 4 is a diagrammatic side cross-sectional view of a portion of the exemplary apparatus of FIG. 1, illustrating an exemplary apparatus for attachment to a front side edge of a speaker cabinet to provide pivotable joints between speaker cabinets, according to a preferred embodiment of the present invention.

FIG. 4 is a diagrammatic side elevation cross-sectional view of a portion of the exemplary adjustable speaker rigging system 100 of FIG. 1, illustrating an exemplary element 400 of an exemplary front coupling apparatus 120 for attachment to a front side edge of a speaker cabinet 118 to provide pivotable coupling 212 between speaker cabinets 118, according to a preferred embodiment of the present invention. The fastener 404 for the tether anchor 214 can be more clearly seen. Receiver 402 for first pivotable coupling portion 106 is formed between second complimentary coupling portion 202 and strip 108. Fasteners 302 are not captive, and can be uninstalled for shipping prior to first installation.

Figure 5:
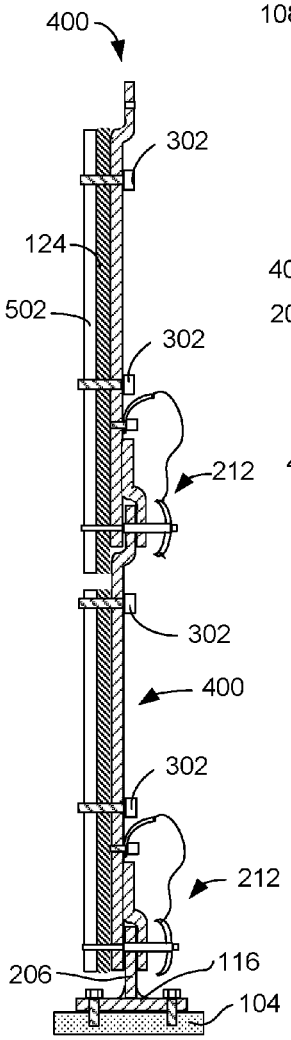
FIG. 5 is a diagrammatic side cross-sectional view of a portion of the exemplary apparatus of FIG. 1, illustrating a pair of exemplary apparatuses of FIG. 4 attached to a front side edge of two speaker cabinets and a dolly coupling of FIG. 1 to provide pivotable joints between speaker cabinets and with the dolly, according to a preferred embodiment of the present invention.

FIG. 5 is a diagrammatic side cross-sectional view of a portion of the exemplary adjustable speaker rigging system 100 of FIG. 1, illustrating a pair of exemplary elements 400 of FIG. 4 attached to a front side edge of two speaker cabinets 118 and a dolly coupling 116 of FIG. 1 to provide pivotable couplings 212 between speaker cabinets 118 and with the dolly 104, according to a preferred embodiment of the present invention. While two elements 400 are shown, it should be appreciated that larger pluralities, or arrays 102, of speaker cabinets 118 may be connected using additional elements 400. Fasteners 302 extend through strip 108, side wall 124, and internal speaker cabinet structural member 502. In a particular embodiment, fasteners 302 may be bolts and be secured by nuts, with or without washers, as appropriate for the particular speaker cabinet 118.

When an array of speakers 102 is disassembled for transport, as on a concert tour, the elements 400 remain attached to the speaker cabinets 118, but the locking pins are pulled out to separate the speaker cabinets 118.

Figure 6:
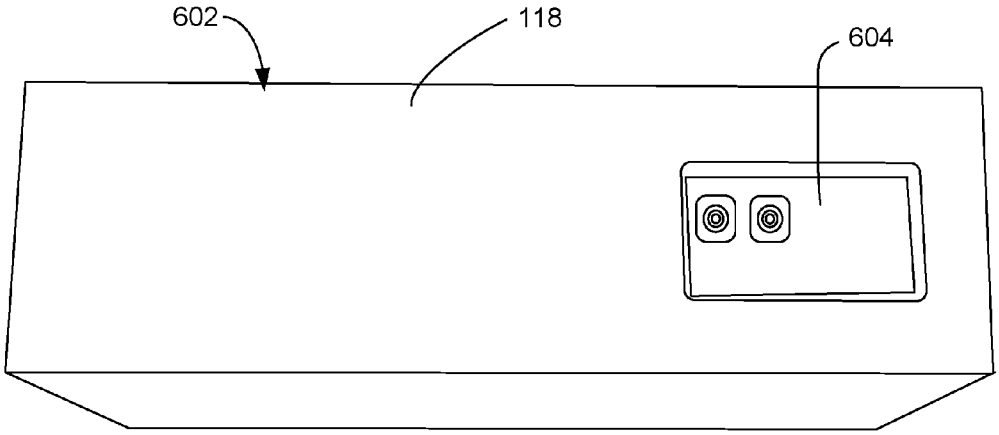
FIG. 6 is a rear lower perspective view of an exemplary speaker cabinet of FIG. 1, according to a preferred embodiment of the present invention.

FIG. 6 is a rear lower perspective view of an exemplary speaker cabinet 118 of FIG. 1, according to a preferred embodiment of the present invention. Speaker cabinet 118 has a rear surface 602. The connection panel 604 is preferably off center to accommodate a rear coupling adjustment apparatus 700 (see FIG. 7).

Figure 7:
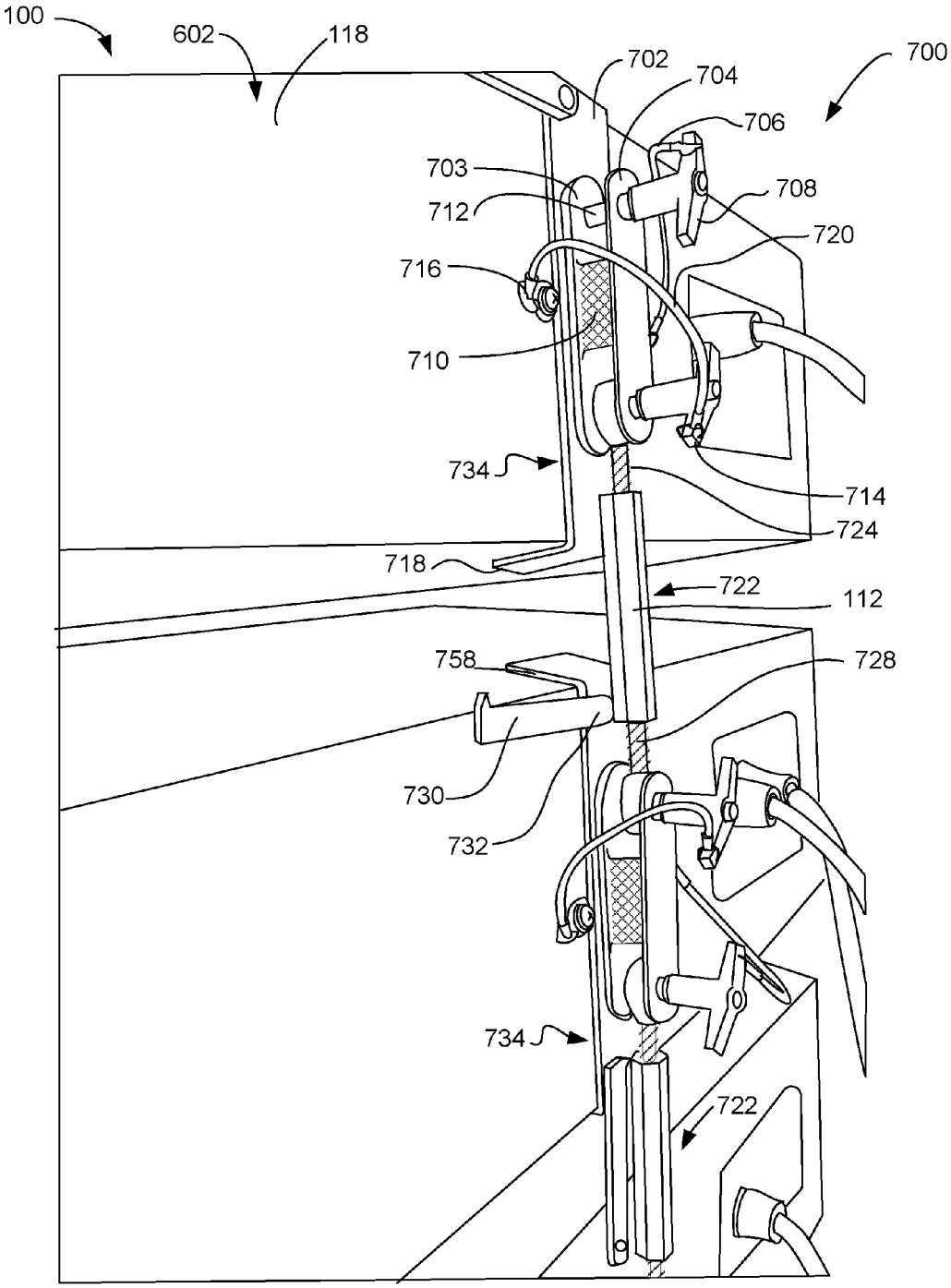
FIG. 7 is a rear side perspective close up view of the speaker cabinets of FIG. 1 illustrating exemplary brackets attached to the rear of the speaker cabinets of FIG. 1 and showing the adjustable coupling between the brackets, according to a preferred embodiment of the present invention.

FIG. 7 is a rear side perspective close up view of the speaker cabinets 118 of FIG. 1 illustrating exemplary brackets 734 attached to the rear of the speaker cabinets 118 of FIG. 1 and showing the adjustable coupling 722 between the brackets 734, according to a preferred embodiment of the present invention. Bracket 734 is based on U-shaped rigid strip 702 that attaches to the top and bottom of the speaker cabinet 118 by means of fasteners through the ends 718 and 758. Lower bracket panel 703 is parallel, abutting, and fixed to U-shaped rigid strip 702. Lower bracket panel 703 is preferably fixed to U-shaped rigid strip 702 by welding, but other methods, both permanent and releasable, are within the scope of the present invention. Lower bracket panel 703 has first and second holes for receiving upper locking pin 708 and lower locking pin 714, respectively. Upper bracket panel 704 is parallel to and spaced apart from lower bracket panel 703, and has first and second holes aligned with the first and second holes in lower bracket panel 703, respectively, for receiving locking pins 708 and 714. Spacer panel 710 is fixed between upper and lower bracket panels 703 and 704. For example, spacer panel 710 may be welded to upper and lower bracket panels 703 and 704, as shown. A second spacer panel 710 is connects the opposing sides of the upper and lower bracket panels 703 and 704, but is not visible in this view.

Upper and lower locking pins 708 and 714 are tethered to the speaker cabinet by tethers 706 and 720, respectively, that are anchored to the rear of speaker cabinet 118. For example, rear tether anchor 716 couples tether 720 to the rear wall of the speaker cabinet 118. The barrel 712 of locking pin 708 may be used to secure an eye end 728 of adjustable coupling 722, such as exemplary turnbuckle 722, as shown.

The adjustable coupling 722 eye ends 724 and 728 are threaded into turnbuckle nut 112. By turning turnbuckle nut 112, the angle, such as $\beta$ or $\gamma$ (see FIG. 9) between the speaker cabinets 118 can be adjusted by pivoting about the front locking pins 110 of the front coupling apparatus 120. Gauge 730, which pivots about pivot pin 732, can be used to measure the angle between the speaker cabinets 118.

Rear coupling adjustment apparatus 700 is the sum of brackets 734 and adjustable couplings 722. In a grounded embodiment, a coupling on the dolly 104 pivotably engages a bottom eye end 728 of an adjustable coupling 722 linked to the bottom bracket 734 on the array 102 to enable adjustment of the angle of the bottom speaker cabinet 118.

Figure 8:
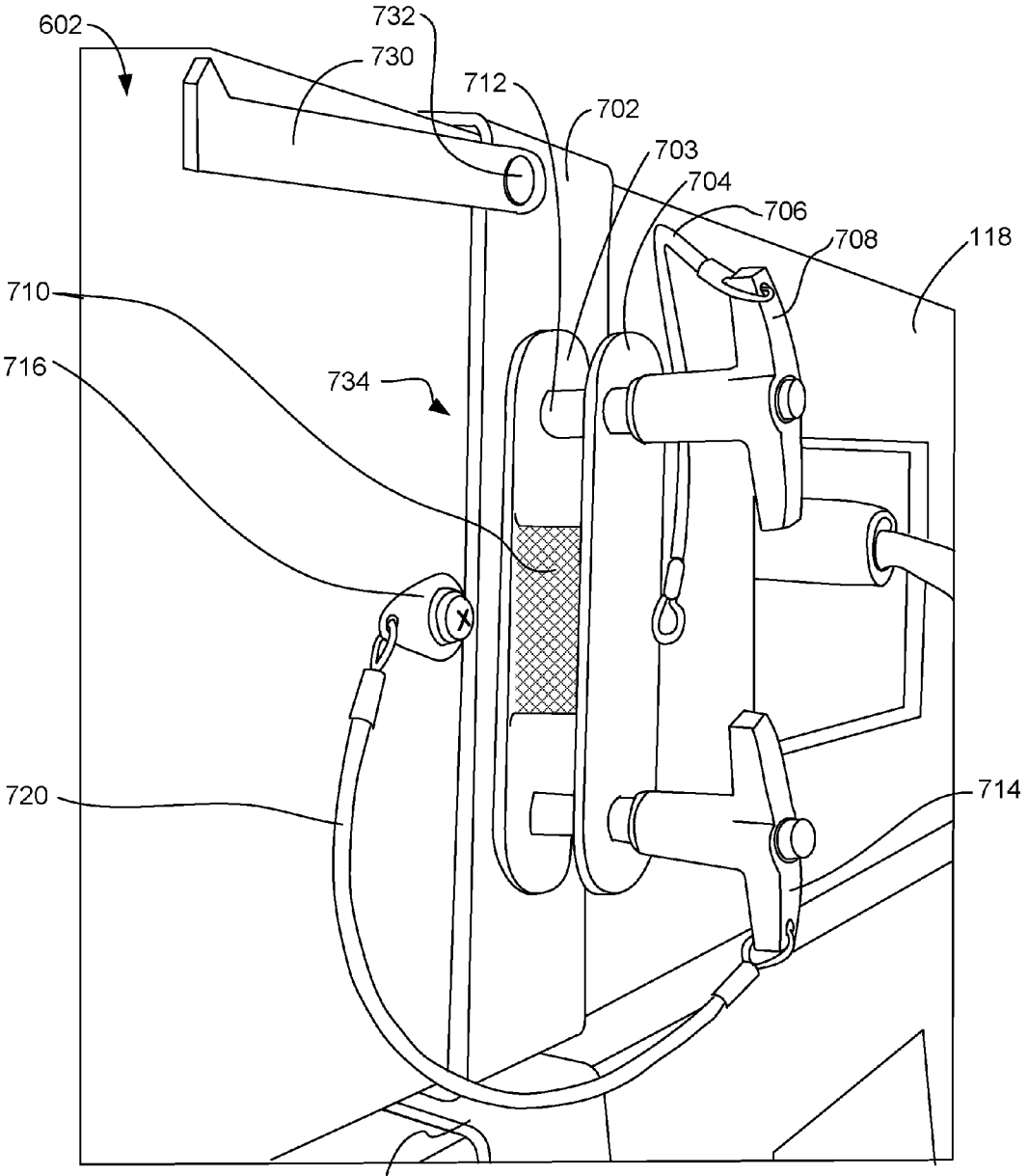
FIG. 8 is a rear side perspective close up view of a speaker cabinet of FIG. 1 illustrating an exemplary bracket attached to the rear of the speaker cabinet of FIG. 1 without the adjustable coupling between the brackets, according to a preferred embodiment of the present invention.

FIG. 8 is a rear side perspective close up view of a speaker cabinet 118 of FIG. 1 illustrating an exemplary bracket 734 attached to the rear of the speaker cabinet 118 of FIG. 1 without the adjustable coupling 722 between the brackets 734, according to a preferred embodiment of the present invention. Bracket 734 is shown without any adjustable coupling 722 installed, for comparison with FIG. 7.

Figure 9:
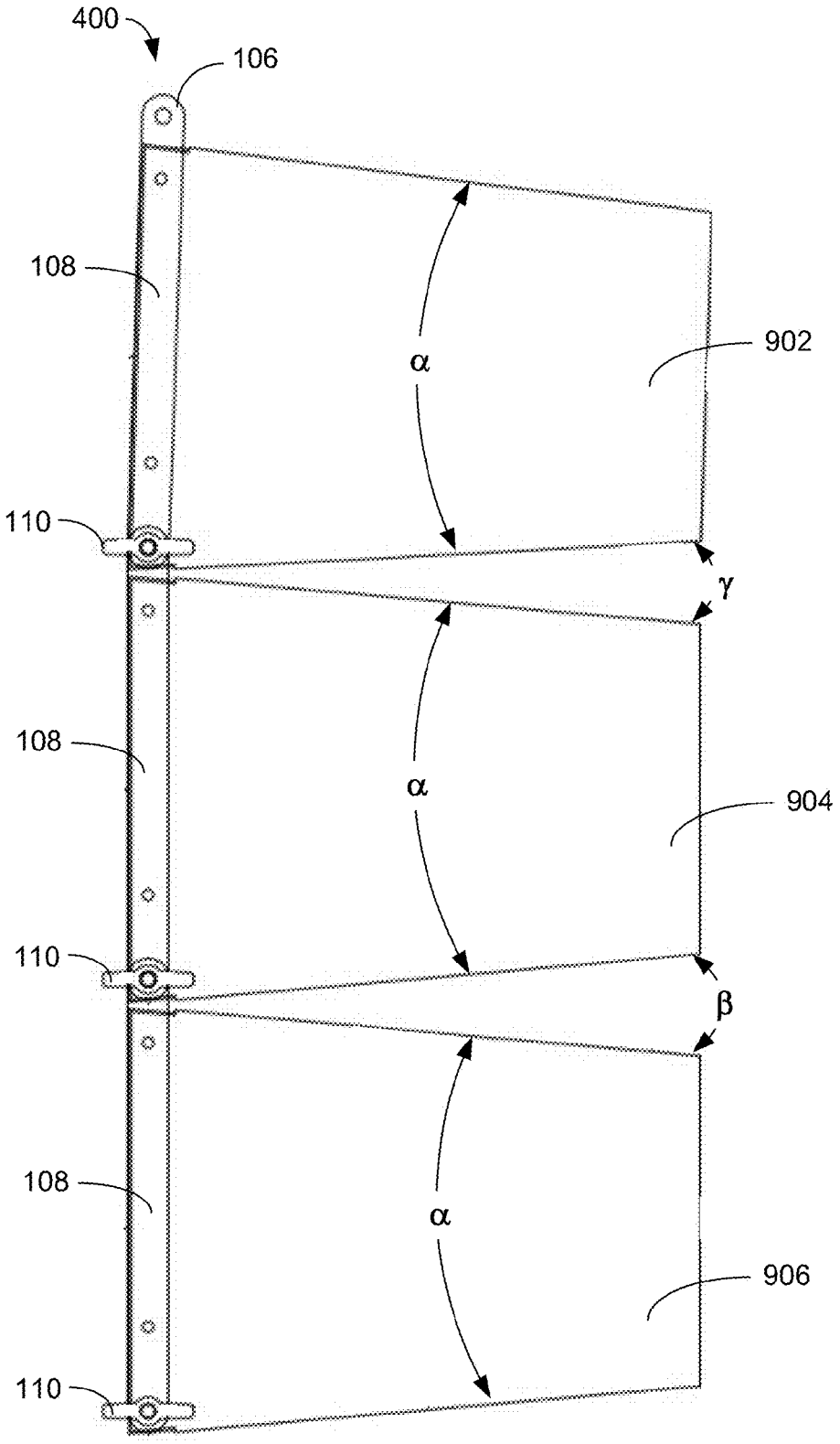
FIG. 9 is a side elevation diagrammatic view illustrating the exemplary apparatus of FIG. 1 and exemplary angular relationships between exemplary speaker cabinets, according to a preferred embodiment of the present invention.

FIG. 9 is a side elevation diagrammatic view illustrating the exemplary adjustable speaker rigging system 100 of FIG. 1 and exemplary angular relationships β and γ between exemplary speaker cabinets 902, 904, and 906 (same as 118), according to a preferred embodiment of the present invention. Speaker cabinets 902, 904, and 906 have a taper angle α, such as ten degrees, from front to back. This leaves room for angular adjustment of the angles β and γ between speaker cabinets 904 and 906, and between speaker cabinets 902 and 904, respectively. The pivot points about which the angle β or γ is adjusted are the locking pins 110 of the front pivotable couplings 212. While a taper angle α is preferably ten degrees, various other taper angles may be used in various other embodiments.

Figure 10:
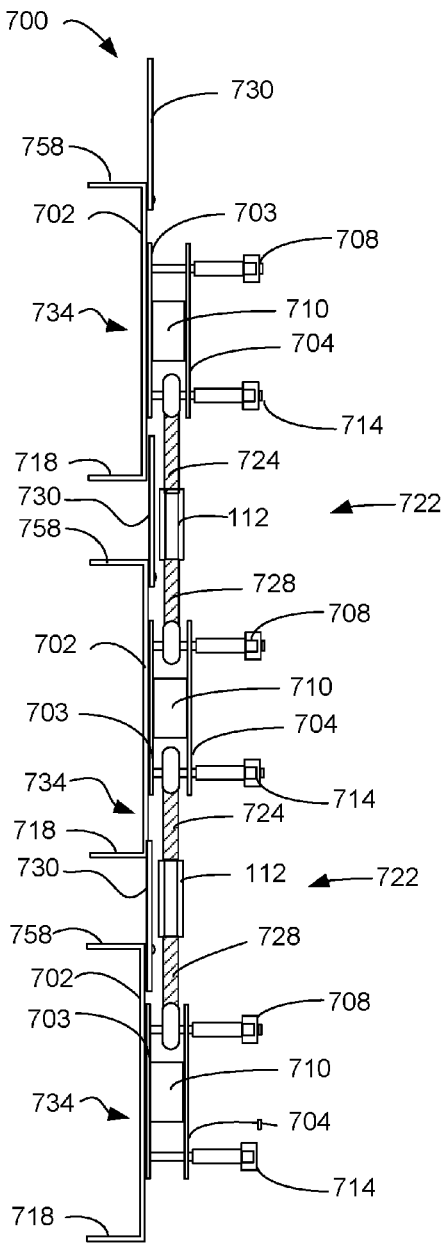
FIG. 10 is a side elevation diagrammatic view illustrating the exemplary continuous adjustment apparatus of FIG. 7, according to a preferred embodiment of the present invention.

FIG. 10 is a side elevation diagrammatic view illustrating the exemplary continuous rear coupling adjustment apparatus 700 of FIG. 7, according to a preferred embodiment of the present invention. Rear coupling adjustment apparatus 700 is the sum of brackets 734 and adjustable couplings 722 and optionally, dolly couplings 116 on dolly 104. Turning the turnbuckle nut 112 creates a continuous adjustment of angles, such as β and γ, as opposed to a discrete incremental adjustment, to allow any angular adjustment desired. In addition, no disassembly is required to make the adjustment, which can be made under load. The number of brackets 734 and adjustable couplings 722 in a rear coupling adjustment apparatus 700 is limited only by the strength of materials used to make brackets 734 and adjustable couplings 722. Those of skill in the art, enlightened by the present disclosure, will appreciate the strength modifications needed for larger rear coupling adjustment apparatuses 700.

Ends 718 and 758 of U-shaped strip 702 have holes for receiving fasteners for fastening brackets 734 to speaker cabinets 118. Fasteners used with ends 718 and 758 fasten to internal structural elements (similar to 502) of the speaker cabinet 118. The end 758, when it is at the top of array 102, may receive a fastener 1402 (see FIG. 14), such as an eye-bolt, that is used to attach the array 102 to a fly frame 1200 (See FIGS. 12-15), for suspending the array 102 by cables or the like. In another embodiment, the top center array coupling to the fly frame may be independent of the U-shaped strip 702.

Figure 11:
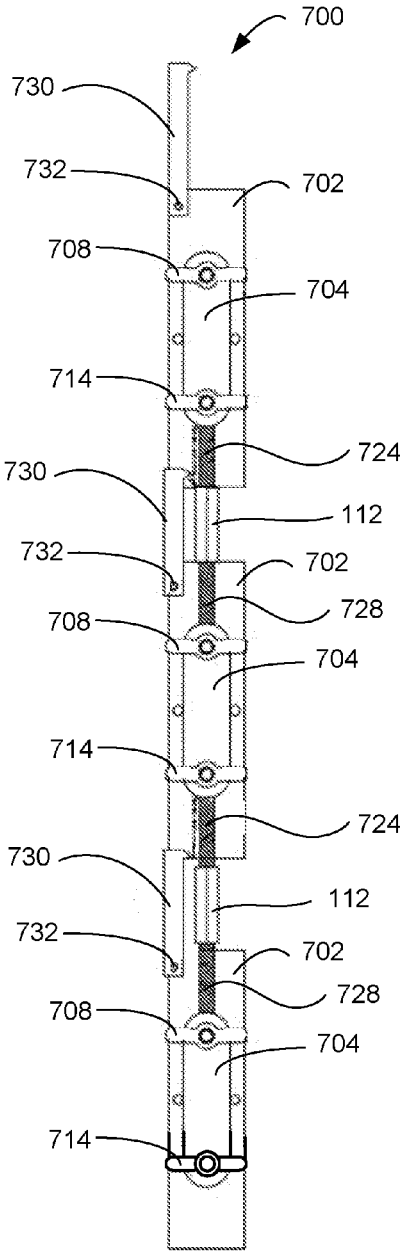
FIG. 11 is a rear elevation diagrammatic view illustrating the exemplary continuous adjustment apparatus of FIG. 7 and FIG. 10, according to a preferred embodiment of the present invention.

FIG. 11 is a rear elevation diagrammatic view illustrating the exemplary continuous adjustment apparatus 700 of FIG. 7 and FIG. 10, according to a preferred embodiment of the present invention. The shape of upper bracket panel 704 is preferred but is not a limitation of the invention. Lower and upper locking pins 708 and 714 may be commercial-off-the shelf locking pins.

The adjustable speaker rigging system 100 comprises at least front coupling apparatus 120 and rear coupling adjustment apparatus 700, which is preferably sold as a kit. Optionally, the adjustable speaker rigging system 100 may include speaker cabinets 118 (with or without audio speakers installed inside, designed to be used with the front coupling apparatus 120 and the rear coupling adjustment apparatus 700. In a particular embodiment, the speaker cabinets may be sold with strips 108 and brackets 734 attached to the speaker cabinets 118 and either coupled or uncoupled from each other. In a particular embodiment, dolly couplings 116 are included with front coupling apparatus 120 and rear coupling adjustment apparatus 700 and, optionally, speaker cabinets 118 and/or dolly 104 are included in a kit. Kits for various sizes of speaker arrays 102 may be discretely packaged and sold. The kit comprises the sum of all necessary parts, packaging, and instructions.

Figure 12:
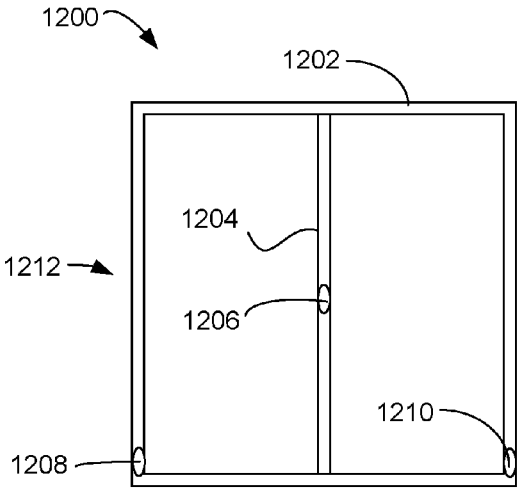
FIG. 12 is a bottom plan diagrammatic view of an exemplary fly frame, according to a preferred embodiment of the present invention.

FIG. 12 is a bottom plan diagrammatic view of an exemplary fly frame 1200, according to a preferred embodiment of the present invention. Fly frame 1200 comprises an outer rectangular (including optional square) frame 1202 with a central cross member 1204. Cross member 1204 supports rear array coupling 1206, while the outer frame 1202 supports front array couplings 1208 and 1210. Array couplings 1206, 1208, and 1210 form a three-point coupling 1212 for speaker array 102. For example, array coupling 1206 attaches to a top coupling of U-shaped rigid strip 702 and array couplings 1208 and 1210 attach to first pivotable coupling portions 106. In particular embodiments, additional frame work may be included, as well as panels and/or supports for amplifiers, receivers, cables, and the like, for supporting such equipment on the fly frame 1200. The three-point coupling 1212, in which one point is proximate the middle of the frame, as shown, is a novel aspect of this fly frame 1200.

Figure 13:
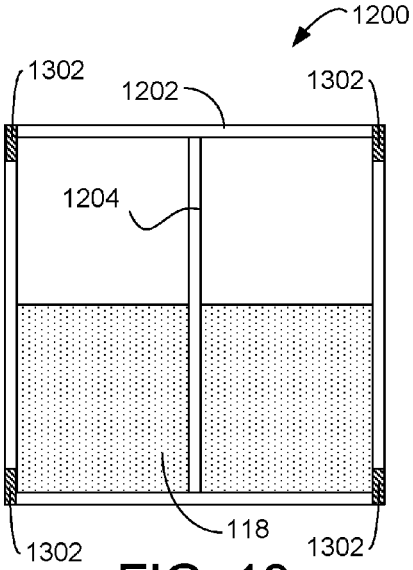
FIG. 13 is a top plan diagrammatic view of an exemplary fly frame suspending an exemplary speaker array, according to a preferred embodiment of the present invention.

FIG. 13 is a top plan diagrammatic view of an exemplary fly frame 1200 suspending an exemplary speaker array 102, according to a preferred embodiment of the present invention. The top of fly frame 1200 shows top suspension cable couplings 1302 proximate the four corners of the outer frame 1202. When suspending the fly frame 1200 and speaker array 102, suspension cables (not shown) are attached to cable couplings 1302. The top surface of a speaker cabinet 118 is shown below the fly frame 1200.

Figure 14:
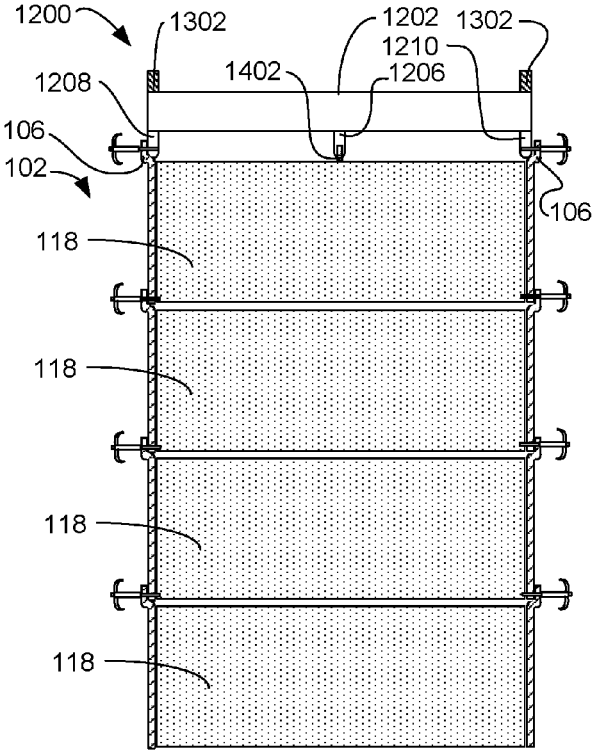
FIG. 14 is a front elevation diagrammatic view of an exemplary fly frame suspending an exemplary speaker array, according to a preferred embodiment of the present invention.

FIG. 14 is a front elevation diagrammatic view of an exemplary fly frame 1200 suspending an exemplary speaker array 102, according to a preferred embodiment of the present invention. Front array couplings 1208 and 1210 of fly frame 1200 are coupled to respective pivotable coupling portions 106 of speaker array 102. Rear array coupling 1206 of fly frame 1200 is coupled to rear array fastener 1402 of speaker array 102. Suspension cable couplings 1302 are shown extending above outer frame 1202. In a particular embodiment, suspension cable couplings 1302 may be integral to and/or within outer frame 1202. Fasteners 1402 and couplings 1206, 1208, 1210, and 1302 may be of various conventional types, selected for the required mechanical strength for the particular installation.

Figure 15:
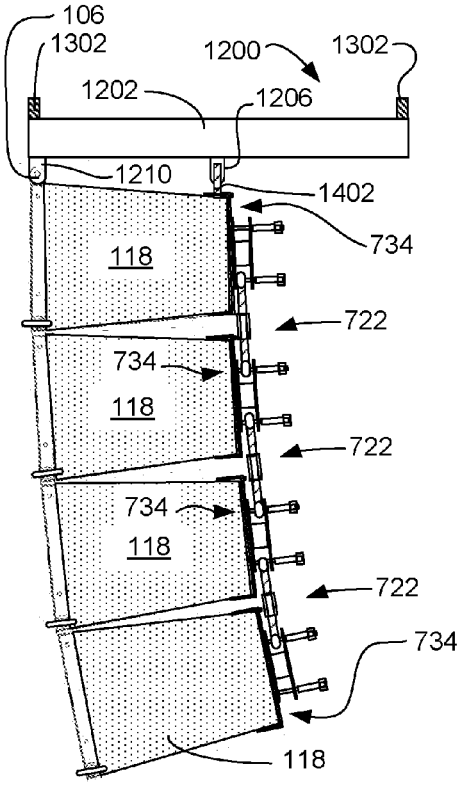
FIG. 15 is a side elevation diagrammatic view of an exemplary fly frame suspending an exemplary speaker array, according to a preferred embodiment of the present invention.

FIG. 15 is a side elevation diagrammatic view of an exemplary fly frame 1200 suspending an exemplary speaker array 102, according to a preferred embodiment of the present invention. The ability to create a "flying" (suspended) speaker array 102 with varied angles between speakers 118 creating a curved front to the speaker array 102 is illustrated. The position of each speaker 118 is determined based on acoustic engineering principles and implemented using the present invention. In a particular embodiment, fastener 1402 and/or rear array coupling 1206 may be adjustable, in order to control the angle of the top speaker 118 of speaker array 102 to the fly frame 1200.

While the illustrated embodiment is shown to be adjustable by a person with a wrench rotating the turnbuckle nut 112, other methods of rotating the turnbuckle nut 112 are not excluded from the invention. For example, a remotely controlled actuator, such as a solenoid, may be mounted on a bracket 734 to turn turnbuckle nut 112 and a similarly mounted sensor/transmitter can provide information about the angle achieved. A control system, addressing each solenoid as an intranet address, for example, is used to make the adjustments easily manageable with a variety of wireless computing devices. This is particularly advantageous for flown installations, especially in venues that reconfigure for various events. For example, a football stadium reconfigured for a rock concert may have different acoustic properties that require adjustment of the flying array 120. Various methods of mounting various types of actuators and sensors will be apparent to those of skill in the art when enlightened by the present disclosure.

Although applicant has described applicant's preferred embodiments of this invention, it will be understood that the broadest scope of this invention includes such modifications as diverse shapes and sizes and materials. Further, many other advantages of applicant's invention will be apparent to those skilled in the art from the above descriptions.

The invention claimed is:

1. An adjustable speaker rigging system for configuring a plurality of speaker cabinets in an array of speaker cabinets into desired adjustable angular relationships, the system comprising:

a. first and second front strings of coupling devices;

b. a rear coupling adjustment apparatus; and c. wherein said rear coupling adjustment apparatus:

i. can be adjusted under load; and ii. comprises:

1. a first plurality of brackets, each bracket configured to be attached to a rear portion of a speaker cabinet of said array of speaker cabinets; and 2. a second plurality of adjustable couplings, each adjustable coupling configured to connect between two brackets of said first plurality of brackets;

d. wherein each bracket comprises:

i. a U-shaped rigid strip;

ii. at least one bracket coupling mounted on said U-shaped strip configured to receive first and second adjustable couplings of said second plurality of adjustable couplings; and iii. at least one tethered lock pin operable to couple said at least one bracket coupling to said first and second adjustable couplings.

2. The adjustable speaker rigging system of claim 1, wherein said first and second front strings of coupling devices each comprises:

a. a plurality of rigid elongated members each having first and second opposing member ends and configured to be attached to a side of a speaker cabinet proximate a front edge of said speaker cabinet;

b. said first opposing member end configured to transversely receive a locking pin;

c. each second opposing member end configured to receive a first opposing member end of another rigid elongated member of said plurality of rigid elongated members and to transversely receive a second locking pin to create a pivotable coupling.

3. The adjustable speaker rigging system of claim 1, wherein each adjustable coupling comprises a continuously adjustable coupling.

4. The adjustable speaker rigging system of claim 3, wherein each adjustable coupling comprises a turnbuckle.

5. The adjustable speaker rigging system of claim 1, further comprising a fly frame configured to make a top three-point connection to said speaker cabinet array.

6. The adjustable speaker rigging system of claim 5, wherein first and second connectors of said top three-point connection are configured to couple to a top of first ends of said first and second front strings of coupling devices, respectively.

7. The adjustable speaker rigging system of claim 1, further comprising a wheeled dolly configured to make a bottom three-point connection to said speaker cabinet array.

8. The adjustable speaker rigging system of claim 7, wherein first and second connectors of said bottom three-point connection are configured to couple to a bottom of second ends of said first and second front strings of coupling devices, respectively.

9. The adjustable speaker rigging system of claim 8, comprising at least two dolly couplings, each comprising:

a. a base plate attachable to said dolly; and b. an upright member extending from said base plate and in the form of a rigid elongated member.

10. The adjustable speaker rigging system of claim 1, further comprising said plurality of speaker cabinets.

11. An adjustable speaker rigging system for configuring a plurality of speaker cabinets in an array of speaker cabinets into desired adjustable angular relationships, the system comprising:

a. first and second front strings of coupling devices;

b. a rear coupling adjustment apparatus; and c. wherein said rear coupling adjustment apparatus:

i. can be adjusted under load; and ii. comprises:

1. a first plurality of brackets, each bracket configured to be attached to a rear portion of a speaker cabinet of said array of speaker cabinets; and 2. a second plurality of adjustable couplings, each adjustable coupling configured to connect between two brackets of said first plurality of brackets;

d. wherein each bracket comprises:

i. a U-shaped rigid strip;

ii. at least one bracket coupling mounted on said U-shaped strip configured to receive first and second adjustable couplings of said second plurality of adjustable couplings; and iii. at least one tethered lock pin operable to couple said at least one bracket coupling to said first and second adjustable couplings; and e. wherein said rear coupling adjustment apparatus can be adjusted continuously.

12. The adjustable speaker rigging system of claim 11, wherein said first and second front strings of coupling devices each comprises:

a. a plurality of rigid elongated members each having first and second opposing member ends and configured to be attached to a side of a speaker cabinet proximate a front edge of said speaker cabinet;

b. said first opposing member end configured to transversely receive a locking pin;

c. each second opposing member end configured to receive one of:

i. a first opposing member end of another rigid elongated member of said plurality of rigid elongated members and to transversely receive a second locking pin to create a pivotable coupling; and ii. a dolly coupling that is attached to a wheeled dolly and to transversely receive a second locking pin to create a pivotable coupling.

13. The adjustable speaker rigging system of claim 11, further comprising a fly frame configured to make a top three-point connection to said speaker cabinet array; wherein first and second connectors of said top three-point connection are configured to couple to a top of first ends of said first and second front strings of coupling devices, respectively.

14. The adjustable speaker rigging system of claim 11, further comprising a wheeled dolly configured to make a bottom three-point connection to said speaker cabinet array; wherein first and second connectors of said bottom three-point connection are configured to couple to a bottom of said second ends of said first and second front strings of coupling devices, respectively.

15. The adjustable speaker rigging system of claim 14, comprising at least two dolly couplings each comprising:

a. a base plate attachable to said dolly; and b. an upright member extending from said base plate and in the form of a rigid elongated member.

16. An adjustable speaker rigging system for configuring a plurality of speaker cabinets in an array of speaker cabinets into desired adjustable angular relationships, the system comprising:

a. first and second front strings of coupling devices; wherein said first and second front strings of coupling devices each comprises:

i. a plurality of rigid elongated members each having first and second opposing member ends and configured to be attached to a side of a speaker cabinet proximate a front edge of said speaker cabinet;

ii. said first opposing member end configured to transversely receive a locking pin;

iii. each second opposing member end configured to receive a first opposing member end of another rigid elongated member of said plurality of rigid elongated members and to transversely receive a second locking pin to create a pivotable coupling; and b. a rear coupling adjustment apparatus, comprising i. a first plurality of brackets, each bracket configured to be attached to a rear portion of a speaker cabinet of said array of speaker cabinets, wherein each bracket of said first plurality of brackets comprises:

1. a U-shaped rigid strip;

2. a second plurality of adjustable couplings, each adjustable coupling configured to connect between two brackets of said first plurality of brackets;

3. at least one bracket coupling mounted on said U-shaped strip configured to receive two adjustable couplings of said second plurality of adjustable couplings; and 4. at least one tethered lock pin operable to couple said at least one bracket coupling to said two adjustable couplings;

c. further comprising one of:

i. a fly frame configured to make a top three-point connection to said speaker cabinet array, wherein first and second connectors of said top three-point connection are configured to couple to a top of first ends of said first and second front strings of coupling devices, respectively; and ii. a wheeled dolly configured to make a bottom three-point connection to said speaker cabinet array, wherein first and second connectors of said bottom three-point connection are configured to couple to a bottom of said second ends of said first and second front strings of coupling devices, respectively;

d. wherein said rear coupling adjustment apparatus can be adjusted under load; and e. wherein said rear coupling adjustment apparatus can be adjusted continuously.

* * * * *